US008243938B2

(12) United States Patent
Boretzki et al.

(10) Patent No.: US 8,243,938 B2
(45) Date of Patent: Aug. 14, 2012

(54) METHOD FOR MANUFACTURING A HEARING DEVICE BASED ON PERSONALITY PROFILES

(75) Inventors: Michael Boretzki, Ruti (CH); Stefan Launer, Zurich (CH); Valentin Chapero-Rueda, Wilen (CH); Hilmar Meier, Zurich (CH)

(73) Assignee: Phonak AG, Stafa (CH)

( * ) Notice: Subject to any disclaimer, the term of this patent is extended or adjusted under 35 U.S.C. 154(b) by 994 days.

(21) Appl. No.: 12/097,995

(22) PCT Filed: Dec. 23, 2005

(86) PCT No.: PCT/CH2005/000773
§ 371 (c)(1),
(2), (4) Date: Sep. 24, 2008

(87) PCT Pub. No.: WO2006/058453
PCT Pub. Date: Jun. 8, 2006

(65) Prior Publication Data

US 2009/0010463 A1 Jan. 8, 2009

(51) Int. Cl.
*H04R 29/00* (2006.01)
*H04R 25/00* (2006.01)

(52) U.S. Cl. ..... 381/60; 381/314; 381/312

(58) Field of Classification Search ..... 381/58, 381/60, 312, 314, 320, 321, 323; 600/559; 73/585

See application file for complete search history.

(56) References Cited

U.S. PATENT DOCUMENTS

| | | | | |
|---|---|---|---|---|
| 7,027,606 | B2 * | 4/2006 | D'Agri | 381/312 |
| 7,068,793 | B2 * | 6/2006 | Shim | 381/60 |
| 7,162,323 | B2 * | 1/2007 | Brumback et al. | 700/118 |

FOREIGN PATENT DOCUMENTS

| | | | |
|---|---|---|---|
| EP | 0695107 | A1 | 1/1996 |
| WO | 0154456 | A1 | 7/2001 |
| WO | 0197564 | A2 | 12/2001 |
| WO | 03030586 | A1 | 4/2003 |

OTHER PUBLICATIONS

"Abbreviated Profile of Hearing Aid Benefit," questionnaire from Harl, Hearing Aid Research Lab, 1994.
Geers Horakkustik, Nov. 14, 2005.
"Instructions for Client Oriented Scale of Improvement (COSI) Administration."
Cox, "Who Wants a Hearing Aid? Personality Profiles of Hearing Aid Seekers," Ear & Hearing, 2005.
Meister, "Detecting Components of Hearing Aid Fitting Using a Self-Assessment-Inventory," Eur Arch Otorhinolaryngol, Dec. 9, 2004.
International Search Report dated May 29, 2008.

* cited by examiner

*Primary Examiner* — Matthew W Such
*Assistant Examiner* — Scott Stowe
(74) *Attorney, Agent, or Firm* — Pearne & Gordon LLP

(57) ABSTRACT

In a method for manufacturing a hearing device, by registering characteristics of an individual (I) a personality vector ($K(C_I)$) is established in a fitting machine. The personality vector ($K(C_I)$) of the individual (I) momentarily involved is compared with stored personality vectors ($K_1(C)$ to $K_n(C)$). That stored personality vector which is most similar to that of the individual (I) is selected and therefrom a personality profile (PP) which is assigned to such personality vector. There is assigned to the personality profile which accords to the most similar personality vector, a respective fitting vector which controls subsequent manufacturing of the hearing device.

9 Claims, 2 Drawing Sheets

METHOD FOR MANUFACTURING A HEARING DEVICE BASED ON PERSONALITY PROFILES

Figure 1:
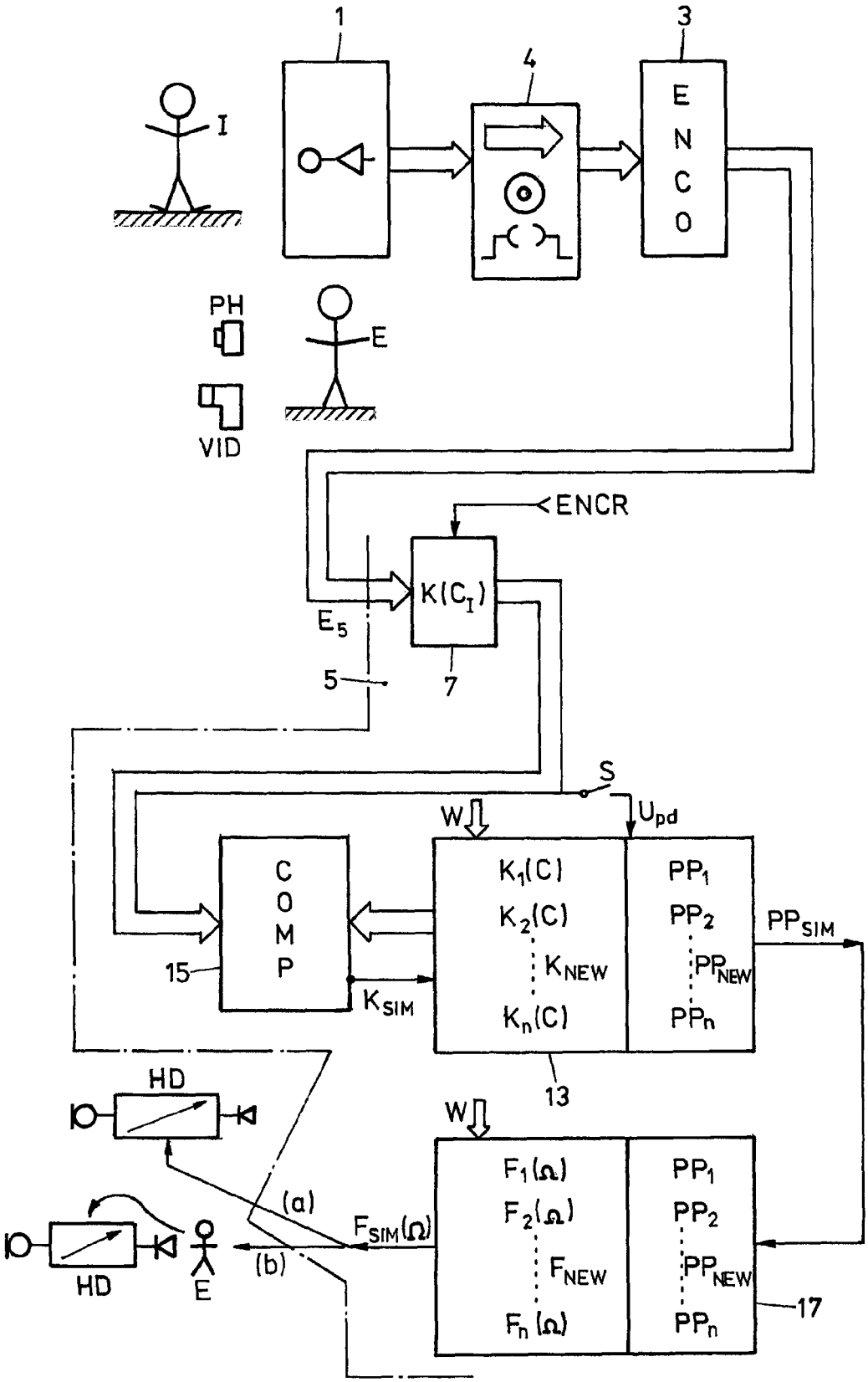

The present invention concerns a method for manufacturing a hearing device which is fitted to an individual. It further concerns a respective fitting method.

We understand throughout the present description and claims under the term "hearing device" a device which acts on acoustical perception of an individual. Thereby such "acting" may be improving perception of acoustical signals but may also be reduction of perception e.g. if the hearing device is a hearing protection device.

The hearing device may further be a hearing device, worn completely in the ear channel, a CIC, may be an in-the-ear hearing device or an outside-the-ear hearing device or even an implantable hearing device. It further may be a monaural or a binaural hearing device. Further such hearing device may be provided for therapeutical purposes as a hearing device to improve acoustical perception of a hearing-impaired individual or may be a hearing help device for normal hearing persons so as to improve their acoustical perception e.g. selectively in specific acoustical surroundings as e.g. in noisy surrounding where, selectively, a speaker should be well perceived.

We understand under "fitting" of a hearing device to the needs of an individual, adapting characteristics of such hearing device to such needs. Such characteristics may e.g. be the type of hearing device (CIC, in-the-ear-, outside-the-ear device) the shape of such device, material of the outer shell and its characteristics, colour etc. "Fitting" further addresses the adjustment and selection of parameters which control the signal-transfer characteristic between an acoustical input and a mechanical output of the hearing device so as to fulfil individual's needs with respect to acoustical perception.

When a fitting operation is performed, commonly by an expert such as an audiologist, this is done primarily based on audiological needs of the individual, geometric characteristics of ear-channel and or of the ear, possibly taking some additional needs of the individual into consideration e.g. with respect to aesthetics.

The present invention departs from the recognition that a huge number of characteristics of an individual for whom a hearing device is to be manufactured do influence the characteristics of an optimally suited hearing device and thus, that a huge number of such characteristics should be taken into consideration for the fitting process. Nevertheless, today fitting machine support of an expert does hardly allow taking as many characteristics of an individual involved into account for the fitting process as would be desirable.

Attention is drawn e.g. to:

Robin M. Cox, "Who Wants a Hearing Aid? Personality Profiles of Hearing Aid Seekers", Ear & Hearing, 2005;

Abbreviated profile of hearing aid benefit" questionnaire from Harl, Hearing Aid Research Lab;

"Instructions for COSI™ Administration"

EP 0 695 107;

WO 01/54456;

WO 03/030586;

WO 01/97564.

It is an object of the present invention to propose a manufacturing method for a hearing device for an individual by which a huge number of characteristics of such individual may be taken into account.

This is achieved by a method for manufacturing a hearing device fitted to an individual which comprises

- registering characteristics of the individual for whom the hearing device is to be manufactured;
- inputing data identifying said characteristics to a fitting machine;
- automatically evaluating, dependent from the data input a personality profile;
- automatically selecting, in dependency of the personality profile, characteristics of a hearing device to be manufactured for the individual and
- manufacturing the hearing device based on such characteristics as automatically selected.

In one embodiment registering of the characteristics of the involved individual comprises at least one of

- behavioural observation of the individual
- interviewing the individual;
- electronically registering at least one of visual and of acoustical behaviour of the individual.

Thereby we understand under "behaviour observation" getting an overall impression of the personality of the individual as may be done by an expert person. This may include performing standarized personality tests, orally or in written.

Still in a further embodiment the addressed characteristics comprise at least one of

- audiologic characteristics;
- visual appearance characteristics;
- psychological characteristics.

We understand thereby under "audiologic characteristics" all characteristics which define for the perception of acoustical signals by the individual. Enclosed under this term are also specific characteristics of language, kind of speaking, voice etc. of the addressed individual.

We understand under "visual appearance characteristics" all characteristics of the individual which may be seen. Such characteristics may be geometry of ear-channel, ear, head and shoulders etc, appearance and movement behaviour of the individual etc.

We further understand under "psychological characteristics" characteristics which define the personality of the individual as e.g. whether such individual is sensible, introverted or extraverted etc.

As according to the present invention a personality profile of the individual involved is exploited and registered, in a further embodiment it is proposed to disable unauthorized persons to read data which contributes to the personality profile of the involved individual. This may, in one embodiment, be realized by encrypting such data.

In a further embodiment the registered characteristics are encoded to generate the data in dependency of which the personality profile is automatically evaluated.

Still in a further embodiment the data inputted to the fitting machine is grouped by this machine to form a personality vector of the individual. Such a personality vector has, as vector elements, data which are indicative for respective characteristics as have been registered in the registering step.

In a further embodiment there is stored a multitude of personality vectors, and there is performed a comparison between the personality vector of the individual involved and the personality vectors as stored.

Storing of the addressed personality vectors may be done in the fitting machine or may be done centrally in a central machine which is accessible from a multitude of fitting machines. Normally the addressed comparing will be performed at the specific fitting machine, especially if the fitting operation is performed interactively with the individual involved. Nevertheless and dependent on the overall data processing architecture, also the addressed comparing may be performed remote from the fitting machine.

In a further embodiment of the present invention by means of the addressed comparing at least one of the personality vectors as stored is determined which is most similar to the personality vector of the individual involved.

Still in a further embodiment, to each of the personality vectors as stored a fitting vector is assigned to. Manufacturing of the hearing device is based on the fitting vector which is assigned to the most similar personality vector as has been found by the addressed comparing.

We understand under a "fitting vector" a set of data elements, each of which defining a specific characteristic of a hearing device which may be adjusted or selected. Such elements may thus define for the type of the hearing device, its shape, material and characteristics of the shell, colour, parameters and their settings for the transfer function of the device etc.

Still in a further embodiment the fitting vector which is assigned to the most similar personality vector is adjusted to even more closely fit to the needs of the individual. Manufacturing is then based on the adjusted fitting vector.

Still in a further embodiment the fitting vectors as stored and assigned to the personality vectors are updated in dependency of at least one adjusted fitting vector.

In one embodiment such updating comprises adding a new fitting vector to the stored fitting vectors in dependency of at least one adjusted fitting vector and assigning such a new fitting vector to a new personality vector which latter is generated in dependency of at least one personality vector of an individual the characteristics of which is or has been registered.

As was already addressed, storing the personality vectors as well the fitting vectors mutually assigned may be done at a centralized machine which is in communication with multiple fitting machines at respective expert locations as by a private or public network. This makes it possible to exploit all the experience with respect to personality profiles to fitting vector assignment which is accumulated at different locations by different experts over time.

According to the present invention there is further proposed a method for fitting a hearing device to an individual which comprises

- registering characteristics of the individual for whom the hearing device is to be manufactured;
- inputting data identifying such characteristics to a machine;
- automatically evaluating, dependent from the input, a personality profile of the individual involved;
- automatically selecting, in dependency of the personality profile as addressed, characteristics of a hearing device for such individual and
- fitting the hearing device based on such characteristics as automatically selected.

Figure 2:
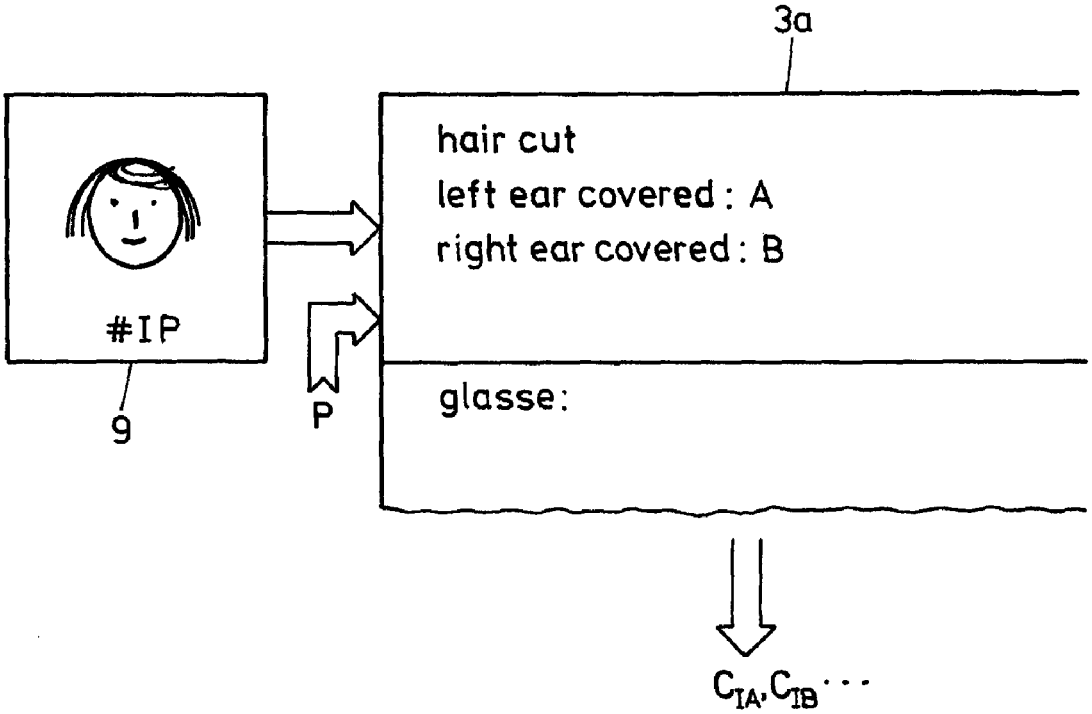
Figure 3:
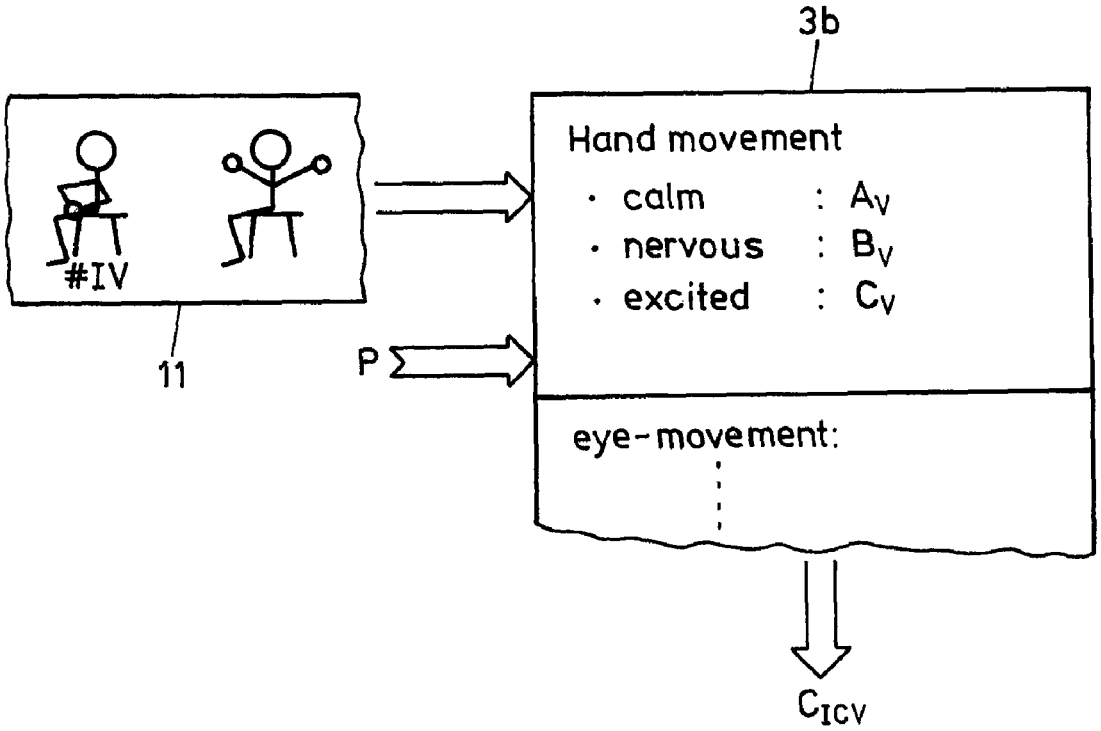

The invention shall now be further exemplified with the help of figures. The figures show:

FIG. 1: a simplified schematic signal-flow/functional-block diagram of a system performing the manufacturing method and fitting method according to the present invention;

FIG. 2: most simplified and schematically, encoding of pictorial information to be exploited as data elements of a personality vector;

FIG. 3: in a representation in analogy to that of FIG. 2, encoding video information for establishing characteristic data as elements of a personality vector according to the present invention.

FIG. 1 shows, by means of a simplified schematic functional-block/signal-flow diagram, a manufacturing method according to the present invention including a fitting method according to the invention.

An individual "I" for whom a hearing device shall be manufactured is subjected to a registering process 1 as schematically shown in FIG. 1. By the registering process 1 characteristics of the individual "I" are registered. Such characteristics include at least one of

- audiological characteristics;
- visual appearance characteristics;
- psychological characteristics of the individual "I" preferably all thereof. The registering process 1 may thereby comprise an interview of the individual involved by an expert person E or may comprise photographic—PH—or video—VID—registration of the individual "I". Registration of characteristics of the individual "I" by an expert E may be performed by filling out a questionnaire with standardized questions and answers. Such questionnaire is filled out in paper form or as displayed on a machine/man/machine interface of a fitting machine 5.

The characteristics of the individual "I" as registered during the registering process 1 are transmitted as schematically shown at 4 of FIG. 1 directly or via a data carrier e.g. a CD or a DVD or via a communication line e.g. a wire and/or wireless network to an input $E_5$ of the fitting machine 5. In the fitting machine 5 or upstream thereof i.e. between registering 1 and input $E_5$ there is performed encoding of the registered characteristics in a form suited for further machine-processing in the fitting machine 5.

If, as an example, registering of characteristics of the individual "I" is performed by behavioural observation and/or an interview, the respective results may be registered in multiple-choice type. By means of encoding of the filled out, standardized answers by encoder 3 the respective characteristics—according to marked answers on the form—are encoded to data $C_I$ which respectively identify the characteristics of the individual "I" as evaluated during the interview.

If registration 1 is performed with a help of digital photographic equipment and as shown in FIG. 2 schematically, an encoder unit 3*a* determines within the digital picture data #IP e.g. specific characteristics of the individual. As a most simple example there is automatically determined by the encoder unit 3*a* whether the individual's hair cut covers the left ear, and/or covers the right ear. By respective detection of pictorial information in the digital picture data #IP and according to the example of FIG. 2 there is detected that the hair cut of the individual momentarily involved covers the left as well as the right ear. Accordingly the encoder unit 3*a* outputs data $C_{IA}$ and $C_{IB}$ which are indicative for the addressed situations. Other characteristics which may be detected and encoded by the encoder unit 3*a* are e.g. whether the individual wears eyeglasses, shape of the ears of the individual "I", shape of head, shoulders etc. etc.

If for the registering process 1 video sequence recording is used, encoding may be performed as schematically shown in FIG. 3. The encoder unit 3*b* detects in the digital video data #IV, as an example, specific parts of the individual as e.g. his or her hands and tracks in that data the movement thereof. The tracked movement of individual's hands is rated as being e.g. "calm", "nervous" or even "excited". Further qualifications of movement might be "lively", "agitated", hyperactive", "dozy" etc. Accordingly the result of the rating is encoded and the respective encoded data is output from the encoder unit 3*b*. In the example of FIG. 3 the movement of individual's hands is considered "excited" and, respectively, the data $C_{ICV}$ is output.

As schematically shown in FIGS. 2 and 3 by the input P, pre-established criterions are preset to the respective encoder units 3*a* and 3*b* for establishing specific categories of the pictorial or video information being tracked. As addressed in FIG. 3 purely as an example other parts of the individual may be tracked as e.g. eye movement, head movement etc.

The data $C_I$ which identifies the characteristics of the individual "I" as registered are entered to a storage unit 7 of the fitting machine. In their combination all these data $C_I$ form a personality vector $K(C_I)$ of the individual involved.

Because such data and personality vector is to be considered as data whereupon no person which is not authorized should have access to and as schematically shown in FIG. 1 at the storage unit 7, such data is protected e.g. by encryption ENCR. Prevention from unauthorized reading of data which identifies characteristics of the individual "I" may be realized already upstream the storage unit 7 as e.g. simultaneously with encoding—3—or even when performing registering 1.

The personality vector $K(C_I)$ of the individual involved is fed within the fitting machine 5 from the storage unit 7 to a comparing unit 15.

Within the fitting machine 5 there is further provided a table storage unit 13. In this table storage unit 13 a multitude of personality vectors $K_1(C)$ to $K_n(C)$ is stored. The personality vectors $K_1(C)$ to $K_n(C)$ represent different combinations of characteristics as may be registered by a registering 1 of different individuals "I". When initializing the system and as shown in FIG. 1, a predetermined number of pre-established personality vectors is entered to table storage unit 13.

In comparing unit 15 the personality vector $K(C_I)$ of the individual momentarily involved is compared with all personality vectors $K_1(C)$ to $K_n(C)$ in table storage unit 13. The comparing unit thereby identifies, out of the personality vectors $K_1(C)$ to $K_n(C)$, which one or which ones is or are most similar to the personality vector $K(C_I)$ of the individual "I" involved. Similarity evaluation may e.g. be made on the basis of comparing elements C with respective elements $C_I$ thereby forming element differences $\Delta C$. There, still as an example, a personality difference vector $\Delta K(\Delta C)$ results. Similarity of one or more than one of the personality vectors as stored in storage unit 13 may be established by considering the values or norm of the respective difference vectors $\Delta K(\Delta C)$. The smaller the values of respective difference vectors $\Delta K$ are, the more the respectively involved personality vectors as stored in storage unit 13 may be considered "similar" to the personality vector $K(C_I)$ of the individual involved. By respective weighting $\alpha$ of the element differences $\Delta C$ in the personality difference vectors $\Delta K(\alpha\Delta C)$ characteristics as registered by registering 1 may be provided with higher or with lower importance.

Once the comparing unit 15 has established the one or the more than one most similar personality vectors of the personality vectors $K_1(C) \ldots K_n(C)$ with respect to the personality vector $K(C_I)$ of the individual momentarily involved, the respective one or more than one most similar personality vectors $K_{SIM}$ is or are addressed in the table storage unit 13.

In table storage 13 to each of the personality vectors $K_1(C)$ to $K_n(C)$ there is assigned a personality profile indication $PP_1$ to $PP_n$ respectively. Thus by addressing the one or more than one most similar personality vectors out of $K_1(C)$ to $K_n(C)$, the respective personality profile indications $PP_{SIM}$ is or are addressed and output from the table storage unit 13.

In a further table storage unit 17 within the fitting machine 5 to each personality profile indication $PP_1$ to $PP_n$ there is assigned a fitting vector $F_1(\Omega)$ to $F_n(\Omega)$. Each fitting vector thereby defines a set of characteristics—$\Omega$—which are to be established, at least in a first approximation, at a hearing device for an individual having the personality profile identified by the respective personality profile indication PP. Such fitting parameters forming the elements of the fitting vectors preferably comprise parameter settings for a transfer characteristic with which acoustical input signals are transmitted in a hearing device to mechanical output signals thereof. In today's hearing devices this transfer characteristic is mostly controlled by at least one digital signal processing unit DSP, and is adjustable by a huge variety of parameters.

The fitting vectors F as stored in the table storage unit 17 do each define a selection of how such parameters should be adjusted at a hearing device to be fitted as closely as possible to an individual "I" having a respective personality profile as identified by the personality profile indication PP.

Thus to each of the personality profile indications $PP_1$ to $PP_n$ in table storage unit 17 a suited fitting vector $F_1(\Omega)$ to $F_n(\Omega)$ is assigned. By addressing the table storage unit 17 with $PP_{SIM}$ indicative of the one or more than one personality profiles most similar to the personality profile of the individual involved, there is thus addressed the one or more than one fitting vectors $F_{SIM}(\Omega)$ for a hearing device to be manufactured for an individual of the addressed personality profile.

As shown at the table storage 13 as well as at the table storage unit 17 with inputs W, at least for initializing the system as shown in FIG. 1 on one hand predetermined personality vectors $K_1(C)$ to $K_n(C)$ and, on the other hand respective predetermined fitting vectors $F_1(\Omega)$ to $F_n(\Omega)$ are pre-established within these table storage units.

When more than one most suited fitting vector $F_{SIM}(\Omega)$ is established at the output of table storage unit 17, an expert as e.g. an audiologist has the possibility to select which one of these vectors shall be applied for fitting a hearing device for the individual involved (not shown in FIG. 1).

The fitting vector $F_{SIM}(\Omega)$ as proposed by the fitting machine 5, possibly after selection by the expert as was just addressed, is, in one embodiment shown by signal path (a), directly applied to a control input of a hearing device HD, with respect to the individual "I" ex-situ or in-situ. Thereby, the transfer characteristic of the hearing device HD, is adjusted based on the fitting vector $F_{SIM}(\Omega)$. In a further embodiment the proposed one or more than one fitting vectors $F_{SIM}(\Omega)$ is or are displayed to an expert E, as to an audiologist, who performs at least a part of the adjustments of the parameters of the transfer function at the hearing device HD manually.

The proposed fitting vector $F_{SIM}(\Omega)$ will only exceptionally be optimized for the respective individual involved. Primarily and especially just after the system as of FIG. 1 has been initialized, such proposed fitting vectors represent some kind of default settings and, based upon such default settings, optimized settings and adjustments of the parameters $\Omega$ will be performed controlled by the expert in communication with the individual involved. Once parameter settings are found which more optimally suit the needs of the individual "I" than the parameter settings as proposed by the output fitting vector $F_{SIM}(\Omega)$, in one embodiment the optimized fitting vector is used to update the fitting vector $F_{SIM}$, e.g. via input W to table storage 17.

In another embodiment before a fitting vector as stored in table storage 17 is updated there is evaluated the most common optimum fitting vector for an addressed personality profile and only after such evaluation over a number of respective individuals "I" belonging to that addressed personality profile, the respective fitting vector in table storage 17 is accordingly updated.

In another approach whenever, departing from a proposed fitting vector $F_{SIM}(\Omega)$, adjustments have to be performed to find more optimum settings at the hearing device HD, such adjusted fitting vector is entered as a new fitting vector $F_{NEW}$ into table storage unit 17. Thereby there is also added a new personality vector $K_{NEW}$ into storage table 13 by loading the personality vector $K(C_I)$ of the individual "I" momentarily involved into storage 13 and assigning to such newly entered personality vector $K_{NEW}$ a respectively new personality profile indication $PP_{NEW}$ which is used within table storage 17 to address the newly entered fitting vector $F_{NEW}$ for further hearing device fittings.

Thus and as has been shown, by the present invention there is proposed a method for manufacturing a hearing device which is fitted to an individual, thereby performing such fitting automatically in dependency of such individual's personality. Due to the fact that there is realized substantial machine-support, a wide variety of characteristics of an individual may be quantitatively taken into account for optimum fitting of a hearing device to such individual's personal needs.

The invention claimed is:

1. A method for manufacturing a hearing device fitted to an individual, comprising:

registering characteristics of the individual for whom the hearing device is to be manufactured;

inputing data identifying said characteristics to a machine;

automatically evaluating, dependent from said data input, a personality profile;

automatically selecting, in dependency of said personality profile, characteristics of a hearing device to be manufactured for said individual; and manufacturing a hearing device based on said characteristics as automatically selected, the method further comprising:

encoding said registered characteristics to generate said data in dependency of which said personality profile is automatically evaluated;

grouping by said machine said data inputted to form a personality vector of said individual;

storing a multitude of personality vectors and comparing said personality vector of said individual with said personality vectors as stored;

determining by said comparing at least one of said personality vectors stored which is most similar to said personality vector of said individual; and assigning to each of said personality vectors stored a fitting vector and manufacturing said hearing device based on the fitting vector assigned to said most similar personality vector.

2. The method of claim 1 wherein said registering of characteristics of said individual, comprises at least one of:

behavioural observation;

standardized written or oral testing of said individual;

interviewing said individual; and electronically registering at least one of visual and of acoustical behaviour of said individual.

3. The method of one of claims 1 or 2, wherein said characteristics of said individual comprise at least one of:

audiologic characteristics;

visual appearance characteristics; and psychological characteristics.

4. The method of claim 1, further comprising disabling an unauthorized person to read data which contribute to said personality profile.

5. The method of claim 4, further comprising encrypting said data.

6. The method of claim 1, further comprising adjusting said fitting vector assigned to said most similar personality vector and basing said manufacturing on a resulting adjusted fitting vector.

7. The method of claim 6, further comprising updating said fitting vectors as stored and assigned to said personality vectors in dependency of at least one adjusted fitting vector.

8. The method of claim 7, wherein said updating comprises adding a new fitting vector to the stored fitting vectors, in dependency of at least one adjusted fitting vector and assigning said new fitting vector to a new personality vector which is generated in dependency of at least one personality vector of an individual, the characteristics of which being or having been registered.

9. A method for fitting a hearing device to an individual comprising:

registering characteristics of the individual for whom the hearing device is to be manufactured;

inputing data identifying said characteristics to a machine;

automatically evaluating dependent from said data input a personality profile in electronic form of said individual;

automatically selecting in dependency of said personality profile, characteristics of a hearing device for said individual; and fitting a hearing device based on said characteristics as automatically selected, the method further comprising:

encoding said registered characteristics to generate said data in dependency of which said personality profile is automatically evaluated;

grouping by said machine said data inputted to form a personality vector of said individual;

storing a multitude of personality vectors and comparing said personality vector of said individual with said personality vectors as stored;

determining by said comparing at least one of said personality vectors stored which is most similar to said personality vector of said individual; and assigning to each of said personality vectors stored a fitting vector and fitting said hearing device based on the fitting vector assigned to said most similar personality vector.

* * * * *